United States Patent [19]

Pitchford

[11] Patent Number: 4,496,103

[45] Date of Patent: Jan. 29, 1985

[54] REACTION DRIVE SPRINKLER

[75] Inventor: Edward J. Pitchford, Glendora, Calif.

[73] Assignee: Rain Bird Sprinkler Mfg. Corp., Glendora, Calif.

[21] Appl. No.: 534,804

[22] Filed: Sep. 22, 1983

Related U.S. Application Data

[62] Division of Ser. No. 377,552, May 12, 1982, Pat. No. 4,434,937.

[51] Int. Cl.[3] ..... B05B 3/08

[52] U.S. Cl. ..... 239/230; 239/233; 239/252

[58] Field of Search ..... 239/230, 233, 247, 252, 239/256, 264, 587

[56] References Cited

U.S. PATENT DOCUMENTS

| | | | |
|---|---|---|---|
| 2,877,053 | 3/1959 | Kennard | 239/233 |
| 3,924,809 | 12/1975 | Troup . | |
| 4,103,828 | 8/1978 | Ridgway | 239/230 |
| 4,161,286 | 7/1979 | Beamer . | |
| 4,177,944 | 12/1979 | Wichman . | |
| 4,231,522 | 11/1980 | Drechsel | 239/233 |
| 4,235,379 | 11/1980 | Beamer . | |

OTHER PUBLICATIONS

National Rain Bird Sales & Eng. Corp. Model No. 100B Adjustable Nozzle "Instructions for Adjustment", 6-1-2-61.

National Rain Bird Sales & Eng. Corp. Sales Publication No. 62-A9 Dec. 1962.

Pp. 21-23, 1979-1980, Rain Bird Irrigation Equipment Catalogue.

Johns Manville Sales Publication Dec. 1977 (Model 211G/221G/250G.

Sime Sales Publication "Mod. Farmer".

Sime Sales Publication "Mod. Super Farmer".

Johns Manville Sales Publication Dec. 1977 (Model 5910).

*Primary Examiner*—John J. Love

*Assistant Examiner*—James R. Moon, Jr.

*Attorney, Agent, or Firm*—Fulwider, Patton, Rieber, Lee & Utecht

[57] ABSTRACT

A reaction drive sprinkler, particularly of the large gun type, is provided with an improved drive assembly adapted for full- or part-circle rotation of the sprinkler in steps about the axis of a water supply standpipe. The sprinkler includes a relatively large and outwardly inclined range tube from which a relatively high energy water stream is projected a substantial distance for irrigation purposes. The drive assembly comprises a drive nozzle mounted on the range tube for bleed passage of a relatively low energy portion of the irrigation water supplied to the range tube and for directing this low energy stream into engagement with one of a pair of oppositely angled deflector spoons at the end of a counterbalanced and pivotally mounted reaction drive arm. The drive nozzle is movable with respect to the range tube and is mechanically shifted by a reversing mechanism for aligning the low energy stream first for cyclic interruption by one of the deflector spoons to rotate the sprinkler stepwise in one direction through a preselected arcuate path and then for cyclic interruption by the other deflector spoon to rotate the sprinkler stepwise in an opposite rotational direction back through the preselected path. In one preferred form, the range tube is supported for rotation by a bearing assembly which includes a force-biased seal member responsive to increasing water pressure for increasing frictional resistance to rotation whereby the stepwise movement of the sprinkler is maintained substantially uniform throughout a range of water pressures. Moreover, the range tube is advantageously provided with a discharge nozzle assembly which is adjustable to select the angle of inclination of the projected high energy water stream.

9 Claims, 14 Drawing Figures

REACTION DRIVE SPRINKLER

This is a division of U.S. patent application Ser. No. 377,552, filed May 12, 1982, and now U.S. Pat. No. 4,434,937.

BACKGROUND OF THE INVENTION

This invention relates generally to rotating water sprinklers used for irrigation purposes. More specifically, this invention relates to an improved rotating sprinkler, particularly of the so-called large gun type, including a reaction drive member for interacting with a projected water stream to rotate the sprinkler in steps and thereby alter the azimuthal direction of the water stream.

Rotating water sprinklers in general are known in the art for use in supplying irrigation water over a substantial surface area. Such sprinklers typically comprise a sprinkler body supported for rotation by a bearing assembly which is in turn adapted for connection to the end of a water supply pipe. Irrigation water is supplied from the supply pipe through the bearing assembly and further through the sprinkler body to a discharge outlet or nozzle from which the water is projected outwardly with a selected angle of upward inclination. A drive arm is pivotally mounted on the sprinkler body and is biased to move a deflector spoon cyclically into interrupting engagement with the projected water stream such that the water stream imparts a torque to the spoon which is transmitted to the sprinkler body to rotate the sprinkler in a series of relatively small rotational steps thereby altering the direction of throw of the projected water stream. This stepwise movement can be allowed to continue through repeated full-circle rotations, or alternatively, if desired, a suitable reversing mechanism of conventional design can be provided to reverse the direction of rotation repeatedly within the limits of a preselected arcuate path.

In a rotating sprinkler of the so-called large gun type used typically in agricultural sprinkler systems, the sprinkler body comprises a relatively large range tube for passage of a relatively high flow of water and for projection of the water a relatively substantial distance from the sprinkler. In this type of sprinkler, the pivoted drive arm typically comprises a reaction arm counterweighted to move a deflector spoon vertically into interrupting engagement with the projected water stream to rotate the range tube in steps with respect to the supporting bearing assembly. If part-circle rotation is desired, a cam mechanism responsive to the rotational position of the range tube moves a reversing cam in front of the projected high flow water stream resulting in a relatively high reaction force for rapidly rotating the range tube back through the preselected arc whereupon the reversing cam is withdrawn from the water stream and normal stepwise rotation by operation of the reaction arm is resumed. Commercial examples of the foregoing type of so-called large gun or reaction drive sprinkler are the Model 102 and Model 103 Rain Guns manufactured by Rain Bird Sprinkler Mfg. Corp. of Glendora, Calif.

A variety of problems and disadvantages are encountered, however, with reaction drive sprinklers of this general type. For example, the reaction arm and the camming mechanism constitute separate structures for use in rotating the sprinkler respectively in opposite directions within the preselected arc, thereby increasing the overall cost and complexity of the reaction drive sprinkler. Moreover, the high reaction forces arising from engagement of the reversing cam with the high flow water stream cause an extremely rapid reverse rotation of the range tube wherein this rapid motion can result in excessive wear to the bearing assembly and/or damage to the various mechanical components of the sprinkler. Further, the rate of rotation in both directions within the preselected arc tends to be at least partially dependent upon the pressure of water supplied to the sprinkler, and this pressure can vary significantly, particularly when multiple sprinklers are coupled at different terrain elevations to a common water supply line.

Still further disadvantages are encountered with respect to interrupting the high flow water stream with the reaction arm. More specifically, interruption of this high flow water stream knocks down a portion of the stream thereby reducing the capability of the sprinkler to provide adequate irrigation at substantial distances. In addition, however, a significant quantity of dirt, grit, or other particulate is entrained with the water stream and impacts the deflector spoon at a sufficient velocity to result in relatively high abrasion of the spoon. Accordingly, the deflector spoon is normally provided as a separate replaceable component mounted on the reaction arm and formed from an abrasion-resistant material, such as bronze or the like.

A variety of modified reaction drive sprinkler constructions have been proposed for alleviating or reducing some of the aforementioned problems encountered particularly with sprinklers of the large gun type. For example, consolidation of the reaction arm and the camming mechanism into a single reaction arm structure having two oppositely oriented deflector spoons has been proposed wherein the spoons interrupt the projected water stream for respective driving of the range tube in opposite directions. However, this reaction arm structure has required a relatively complicated mechanical mounting arrangement for accommodating the normal pivoting movement thereof in addition to selective lateral shifting of the arm to align the different spoons with the water stream. Alternatively, sprinklers have been proposed wherein a secondary nozzle is provided through which a relatively low flow water stream is discharged, and the reaction arm and camming mechanism interrupt this lower flow water stream to drive the range tube reversibly with lower forces within the limits of the preselected arc. While sprinklers of this latter type advantageously provide driving forces of lower magnitude and experience significantly reduced abrasion problems, they still have relied upon mechanically complex drive structures which undesirably increase the cost and complexity of the sprinkler.

There exists, therefore, a need for an improved reaction drive sprinkler particularly of the large gun type, having a single reaction arm of simplified construction for reversibly rotating the sprinkler with relatively low driving forces and without interrupting the high flow water stream projected from the sprinkler. The present invention fulfills this need.

SUMMARY OF THE INVENTION

In accordance with the invention, a reaction drive sprinkler is provided with a relatively large range tube projecting outwardly and inclined upwardly from, and rotatable with respect to, a bearing assembly adapted for connection to the upper end of a water supply standpipe or the like. Irrigation water supplied from the standpipe flows upwardly into and through the range tube and is discharged as a relatively high energy flow stream upwardly and outwardly therefrom. A relatively low energy portion of the water within the range tube is bled off for discharge passage through a relatively small drive nozzle. This low energy stream is cyclically interrupted by one of a pair of oppositely oriented deflector spoons on a reaction drive arm mounted pivotally to the range tube such that reaction forces between the water and the spoon rotationally drive the sprinkler in steps about the axis of the standpipe. The drive nozzle is movable with respect to the range tube and in response to operation of a reversing mechanism for movement between a first position directing the low energy water stream into engagement with one of the deflector spoons for driving the range tube in one rotational direction through a preselected arcuate path and then to a second position for directing the low energy stream into engagement with the other deflector spoon for driving the range tube in the opposite rotational direction through the preselected arcuate path.

In one preferred form of the invention, the drive nozzle is formed from a flexible rubber-based or plastic material to include an enlarged base retained in seated sealing engagement with the range tube and an outwardly projecting nozzle tube disposed in alignment with a bleed opening in the range tube. This bleed opening is formed in the range tube at a position bleeding a relatively low energy or swirling portion of the water passing through the range tube. Accordingly, this low energy portion of the water is bled off for passage through the bleed opening and further through the nozzle tube for discharge therefrom as a relatively low flow, low pressure water stream.

A reversing mechanism coupled between the range tube and the bearing assembly is responsive to the rotational position of the range tube to switch a bracket arm between two positions each time the range tube reaches an end limit of a preselected arcuate path of rotation. This bracket arm is connected to the nozzle tube of the drive nozzle and functions to move the nozzle tube laterally through a relatively small angular deviation between the first and second drive nozzle positions.

The reaction arm is supported by the range tube for simple pivoting motion about a generally horizontal axis to swing the pair of oppositely oriented deflector spoons to a position generally in the path of the low energy water stream projected from the drive nozzle. The drive nozzle directs the low energy water stream for engagement cyclically with one of the deflector spoons to impart a torque to the reaction arm which in turn is transmitted to the range tube whereby the range tube is rotated stepwise in one rotational directon within the preselected arcuate path. When an end limit of the arcuate path is reached, the reversing mechanism including the bracket arm switches the drive nozzle to its alternative position whereupon the low energy water stream is realigned for engagement cyclically with the other deflector spoon to rotate the range tube in a reverse direction within the preselected arcuate path.

According to further aspects of the invention, the bearing assembly includes a bearing case adapted for connection to the water supply standpipe and for supporting suitable bearings, such as ball bearings or the like, coupled between the range tube and the case to accommodate relative rotation of the range tube. A force-biased seal member is retained between the bearing case and a friction collar at the lower end of the range tube to prevent water leakage into contact with the encased bearings and to provide an increasing frictional resistance to range tube rotation in response to increasing water pressure. In a preferred form, the force-biased seal member comprises a lip seal of generally U-shaped cross section into which is received a generally U-shaped spring for urging the opposed leg of the lip seal respectively into bearing contact with the bearing case and the friction collar. When water under pressure is supplied to the sprinkler, the pressurized water assists the spring force to increase frictional resistance between the friction collar and the bearing case and thereby maintain rotational stepping of the range tube substantially constant throughout a range of water supply pressures.

According to still further aspects of the invention, the range tube supports at its discharge end a nozzle assembly adapted for selecting the angle of inclination of the high energy water stream. The nozzle assembly includes a support ring for snap-fit engagement into the discharge end of the range tube and for defining an outwardly presented seat for a selected one of interchangeable nozzle inserts. Importantly, the selected nozzle insert is positioned by the support ring in slight misalignment with a centerline of the range tube such that the angle of inclination of the high energy water stream projected through the nozzle insert can be adjusted by appropriate orientation of the support ring within the discharge end of the range tube. A retainer nut threadably fastens into the support ring for axially bearing engagement with a flange on the nozzle insert to retain the nozzle insert in place.

Other features and advantages of the present invention will become apparent from the following description, taken in conjunction with the accompanying drawings, which illustrate, by way of example, the principies of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
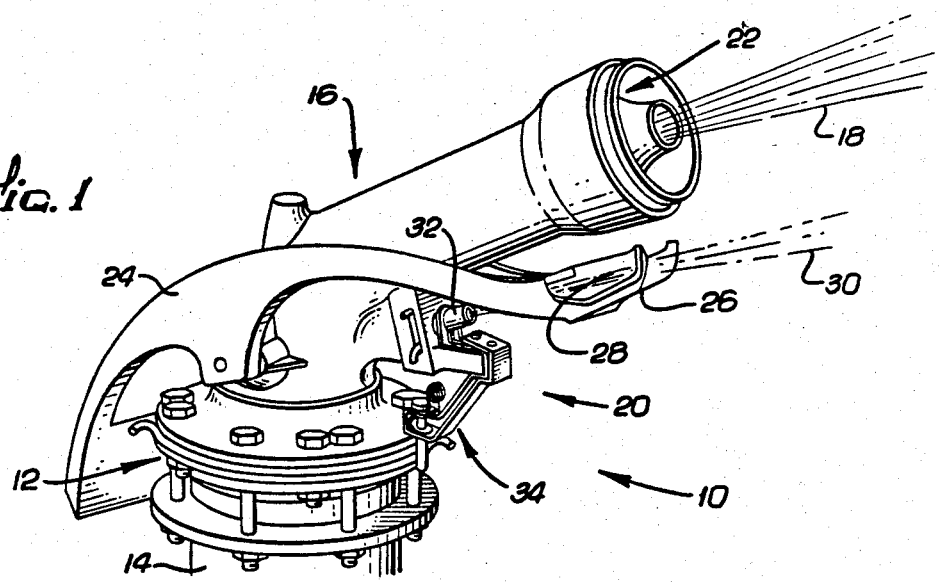
FIG. 1 is a perspective view illustrating a reaction drive sprinkler embodying the novel features of the invention.
Figure 6:
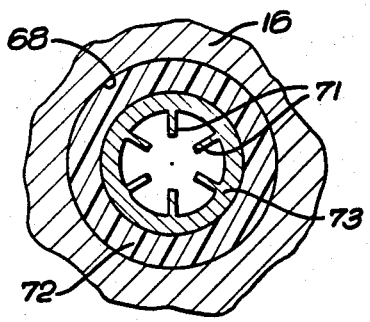
FIG. 6 is an enlarged fragmented section taken generally on the line 6—6 of FIG. 3.
Figure 5:
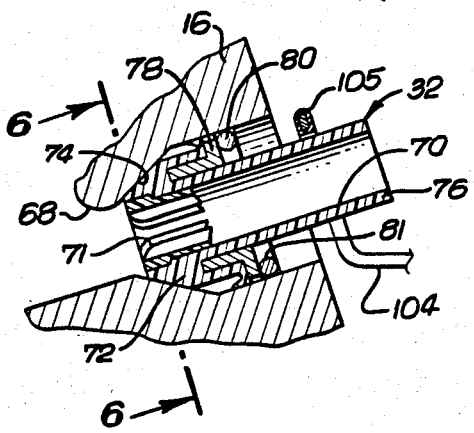
FIG. 5 is an enlarged fragmented vertical section of a portion of the sprinkler to illustrate construction details of a movable drive nozzle.
Figure 8:
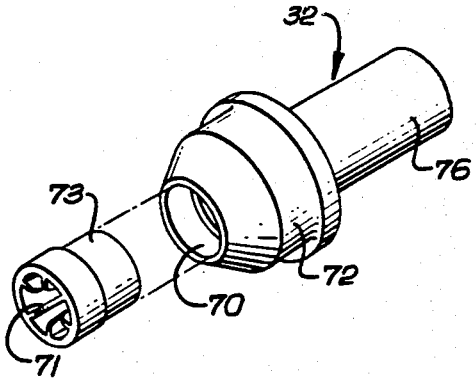
FIG. 8 is an enlarged perspective view illustrating the drive nozzle in exploded relation with a set of antiswirl vanes.
Figure 7:
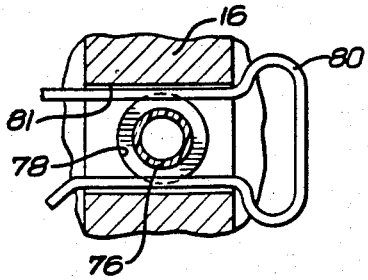
FIG. 7 is a fragmented section taken generally on the line 7—7 of FIG. 5.

As shown in the exemplary drawings, the present invention is embodied in a new and improved reaction drive sprinkler designated generally by the reference numeral 10 for use in the irrigation of a substantial surface area, including crops, lawn areas, and the like. The reaction drive sprinkler 10 is illustrated generally in FIG. 1 in the form of a so-called large gun sprinkler including a bearing assembly 12 adapted for connection to the upper end of a water supply standpipe 14 and a range tube 16 supported by the bearing assembly for rotation generally about the axis of the standpipe. Irrigation water supplied from the standpipe at a relatively high flow and pressure flows through the range tube and is projected therefrom generally in a laterally outward and inclined direction as a relatively high energy water stream 18.

In accordance with the invention, the reaction drive sprinkler 10 is provided with an improved drive assembly 20 for rotatably driving the range tube 16 in a stepwise fashion about the axis of the standpipe 14 and for reversing the direction of rotation within the limits of a preselected arcuate path, whereby the water stream 18 is swept back and forth through the arcuate path for irrigating a substantial surface area. In addition, the reaction drive sprinkler 10 includes an improved nozzle assembly 22 at the discharge end of the range tube 16 for permitting selective adjustment in the angle of inclination of the projected high energy water stream 18.

The drive assembly 20 for the reaction drive sprinkler 10 is designed with a simplified mechanical construction to include a single reaction drive arm 24 mounted on the range tube 16 for simple pivoting motion wherein the reaction arm supports two deflector spoons 26 and 28 for use in reversible rotational driving of the range tube. These deflector spoons 26 and 28 advantageously avoid interrupting the high energy water stream 18 projected from the range tube 16 thereby permitting optimum range of throw of the water stream 18 for optimum irrigation surface coverage. Instead, the deflector spoons 26 and 28 are positioned for cyclic interruption of a relatively small and low energy water stream 30 which is diverted from the high energy portion and bled through a relatively small drive nozzle 32. This drive nozzle 32 is mechanically shifted by a relatively simple reversing mechanism 34 to direct the low energy water stream 30 first into alignment with the deflector spoon 26 for rotation of the range tube in one direction within a preselected arcuate path and then for alignment with the other deflector spoon 28 for rotation of the range tube in an opposite direction within the limits of the preselected arcuate path. Accordingly, movement of the range tube 16 back and forth within the arcuate path is in response to relatively low driving forces provided by the low energy water stream 30 thereby avoiding excessive wear and/or damage from rapid reversals and excessive abrasion of the deflector spoons. In addition, the bearing assembly 12 advantageously includes a force-biased seal member (not shown in FIG. 1) which responds to the water pressure within the standpipe 14 to vary frictional resistance to range tube rotation in a manner maintaining the rate of rotation substantially constant throughout a range of water pressures.

Figure 2:
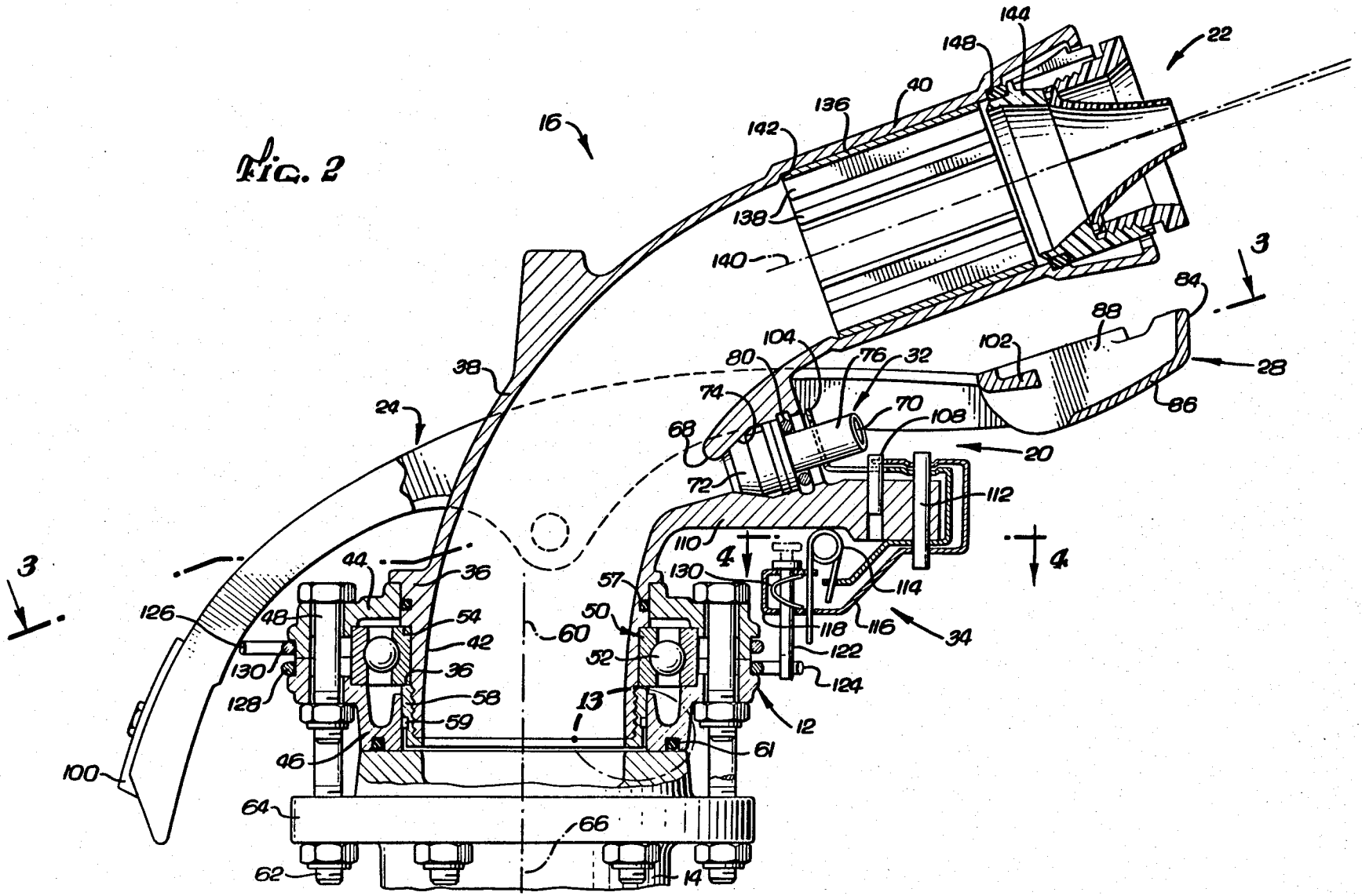
FIG. 2 is an enlarged vertical section of the reaction drive sprinkler shown in FIG. 1.

The illustrative reaction drive sprinkler 10 is shown in more detail in FIG. 2, which illustrates the range tube 16 in the form of a hollow generally tubular and unitary structure which can be machined or cast to have a lower end portion 36 supported for rotation by the bearing assembly 12. From the lower end portion 36, the range tube pro3ects upwardly and then curves smoothly through an elbow portion 38 which in turn merges with a discharge barrel 40 projecting generally in a laterally outward direction with a selected angle of inclination. Importantly, the range tube 16 defines a continuous and generally smooth-walled flow path 42 for passage of water from the standpipe 14 upwardly through the lower end portion 36, the elbow portion 38, and further through the discharge barrel 40 for projection upwardly and outwardly from the sprinkler as the relatively high energy water flow stream 18.

The bearing assembly 12 is carried about the lower end portion 36 of the range tube 16 and is adapted for connection to the upper end of the water supply standpipe 14. More specifically, as shown in detail in FIG. 2, the bearing assembly 12 comprises a bearing case defined by a pair of generally complementary-shaped annular case halves 44 and 46 secured together by a plurality of connecting bolts 48 and cooperating with one another to form an annular bearing chamber 50 for seated reception of suitable bearings 52, such as ball bearings, interposed between the case and the lower end section 36 of the range tube. The bearings 52 are axially restrained in position about the range tube 16 between an upper shoulde 54 formed integrally about the circumference of the range tube and a lower shoulder 56 defined by the axially upper extent of a friction collar 58 threaded onto the lowermost end of the range tube. Conveniently, the bearings are isolated within the chamber 50 from inflow of water by an upper annular seal member 57 between the uppe case half 44 and the range tube and by a lower annular seal member 59 between the lower case half 46 and the friction collar 58.

In use, the bearings 52 permit rotation of the range tube 16 about a central axis 60 of the lower end portion 36 of the range tube with respect to the bearing case. The bearing case is in turn connected to the water supply standpipe 14 by means of mounting bolts 62 or the like fastened through the case halves 44 and 46 and secured to a flange 64 on the standpipe to align the range tube lower end portion with a central axis 66 of the standpipe. A seal ring 61, such as an O-ring or the like, can be trapped between the lower case half 46 and the standpipe flange 64 to prevent water leakage therebetween. Accordingly, water from the standpipe is free to flow upwardly into and through the range tube 16 for discharge therefrom in the form of the high energy water stream 18, with the bearing assembly 12 permitting rotation of the range tube about the axis 66 of the standpipe to sweep the irrigation water over a prescribed surface area.

The range tube 16 is rotatably driven with respect to the standpipe 14 by the improved drive assembly 20 which is illustrated in a preferred form in FIGS. 2–8. As shown, the drive assembly 20 includes the drive nozzle 32 positioned for diverting a relatively small and inherently relatively low pressure portion of the water within the range tube from the major relatively high pressure portion which is ultimately discharged from the barrel 40 of the range tube. More specifically, this lower energy portion of the water is obtained from a position along the inside curvature of the elbow portion 38 wherein the water experiences substantial energy loss as a result of substantial localized turbulence or vortex swirl, as recognized by commonly assigned U.S. Pat. No. 3,924,809. A bleed opening 68 in the range tube along the inside curvature of the elbow portion 38 permits this lower energy water to bleed out through the drive nozzle and to be projected therefrom as the low energy water stream 30.

The drive nozzle 32 is retained in seated alignment with the bleed opening 68 and defines an outlet bore 70 through which the low energy water stream is discharged. If desired, antiswirl vanes 71 can be provided to radiate inwardly from a support collar 73 trapped between the drive nozzle and the outlet bore to refine the geometry of the low energy water stream. Importantly, the drive nozzle 32 is movable with respect to the range tube 16 to selectively control the direction of throw of the low energy water stream 30 and thereby control the direction of rotational movement of the range tube with respect to the standpipe, as will be described in more detail.

In accordance with one preferred form, the drive nozzle 32 is formed from a flexible rubber-based or plastic material to include an enlarged base 72 having a generally frusto-conical seat surface for sealing and seated engagement with a matingly shaped seat 74 surrounding the outboard side of the bleed opening 68. The nozzle base 72 is formed integrally with an elongated nozzle tube 76 which projects generally in a lateral direction beneath and generally in parallel with the upwardly inclined discharge barrel portion 40 of the range tube. The drive nozzle 32 is retained in position by a thrust washer 78 held in bearing engagement with an outboard side of the nozzle base 72 by a removable retaining spring 80 inserted through a laterally open slot 81 in the range tube.

Figure 3:
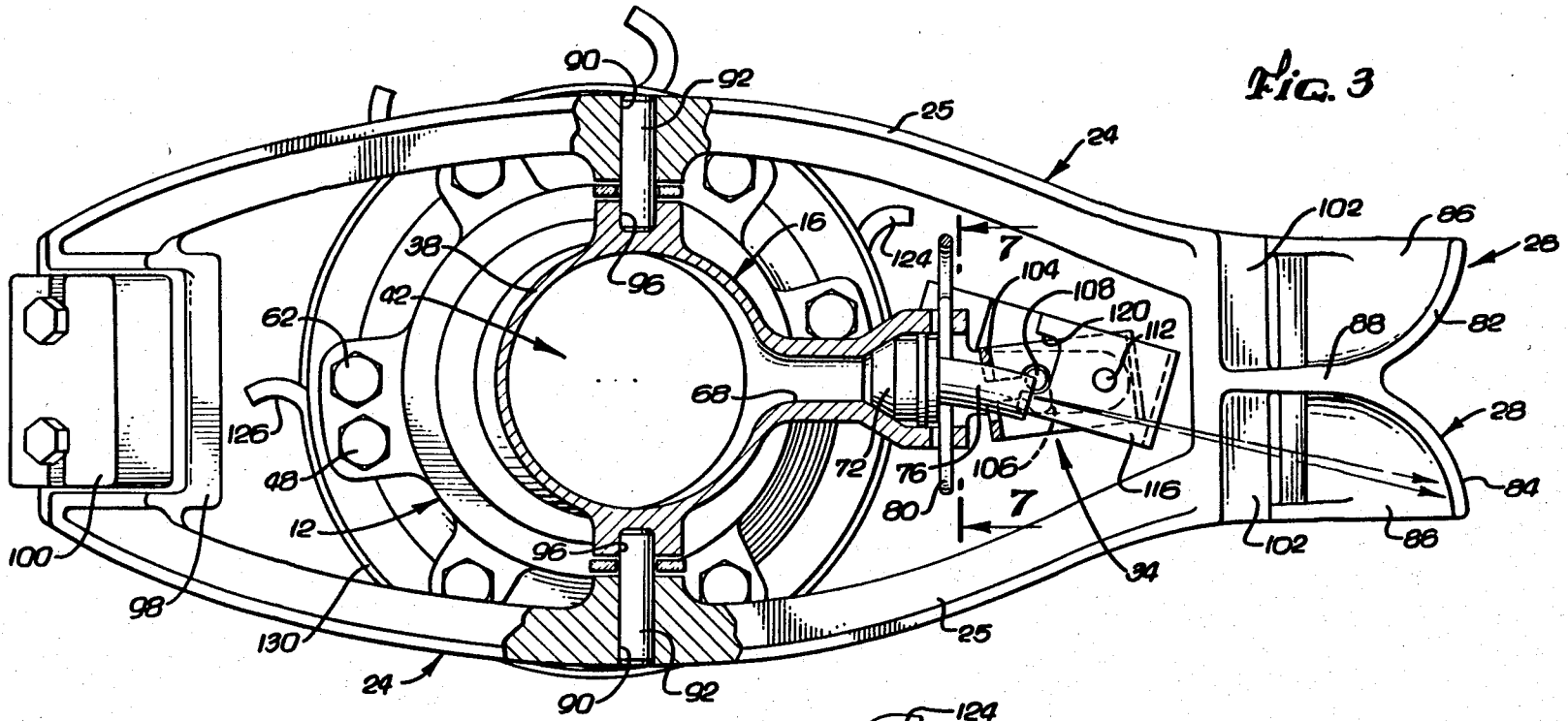
FIG. 3 is a longitudinal, generally horizontal section taken on the line 3—3 of FIG. 2.
Figure 4:
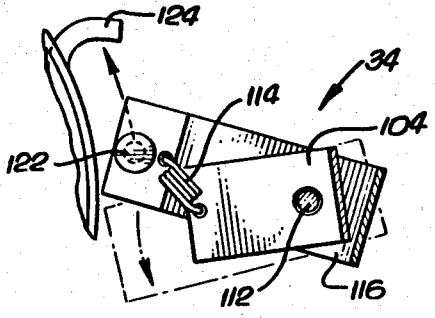
FIG. 4 is a fragmented horizontal section taken on the line 4—4 of FIG. 2.

The low energy water stream 30 discharged from the drive nozzle 32 is projected in a direction for engagement with a selected one of the deflector spoons 26 and 28 on the reaction drive arm 24. These spoons 26 and 28, as illustrated best in FIGS. 1–3, are supported at a front end of the reaction arm 24 in a position generally beneath the discharge barrel portion 40 of the range tube. The spoons comprise laterally outwardly and oppositely curved deflector walls 82 and 84 upstanding from a platform 86 and separated by a central divider vane 88 extending generally toward the drive nozzle. Accordingly, when one of the spoons 26 and 28 is moved to a position interrupting the low energy water stream 30, the stream 30 is deflected laterally to impart a directionally opposite reaction force to the spoon which is in turn transmitted to the reaction drive arm 24.

The reaction drive arm 24 is mounted on the range tube 16 for simple pivoting motion about a generally horizontal axis, as viewed in FIGS. 1–3, to swing the deflector spoons 26 and 28 vertically into and out of engagement with the low energy water stream 30. To this end, the exemplary reaction drive arm comprises a pair of arm sections 25 extending rearwardly from the opposed side margins of the deflector spoons on both sides of the range tube whereat the arm sections are enlarged to define a pair of transversely aligned bores 90 for receiving relatively short pivot pins 92. These pivot pins 92 can be secured in place by set screws or the like (not shown) to project into adjacent, laterally outwardly open sockets 96 formed at the sides of the range tube. From the pivot pins 92, the arm sections 25 extend rearwardly to a position behind the range tube 16 where they are joined together by a platform 98 forming a mounting structure for a counterbalance weight 100 of a selected mass.

The weight 100 has a sufficient mass to cause pivoting of the reaction drive arm 24 about the horizontal axis defined by the pivot pins 92 to swing the deflector spoons 26 and 28 upwardly toward the path of the low energy water stream 30. This pivoting motion brings one of the spoons 26 or 28, depending upon the position of the drive nozzle 32, into interrupting engagement with the water stream 30. Conveniently, cross vanes 102 extend crosswise in front of the deflector walls 82 and 84 and are oriented for initial engagement by the water stream 30 to pull the spoon relatively sharply into interrupting engagement with the water stream 30. The water stream 30 is deflected by the associated curved deflector wall laterally away from the spoon resulting in a reaction force imparted to the spoon and transmitted through the reaction arm 24 to the ranqe tube thereby rotating the range tube through a relatively small angular increment with respect to the standpipe 14. The reaction force also drives the deflector spoon downwardly out of engagement with the water stream 30 against the mass of the weight 100, whereupon the weight eventually overcomes the downward driving force and swings the spoon back into interrupting engagement with the water stream for rotating the range tube through another incremental step.

In accordance with a primary aspect of the invention, the drive nozzle 32 is movable for selectively aligning the low energy water stream 30 for cyclic interruption by the deflector spoon 26 to rotate the range tube 16 in one direction, or for aligning the water stream 30 for cyclic interruption by the other deflector spoon 28 to rotate the range tube 16 in an opposite direction. The switching movement of the drive nozzle is controlled by the reversing mechanism 34 which moves the drive nozzle from alignment with one spoon to alignment with the other spoon each time the range tube rotates to an end limit of a preselected arcuate path. Accordingly, the high energy water stream 18 is swept back and forth in a stepwise rotation through the arcuate path to irrigate an arcuate surface area.

The reversing mechanism 34 comprises a bracket arm 104 having an upper end wrapped about the nozzle tube 76 of the drive nozzle, as shown in FIGS. 1—4. The bracket arm 104 extends downwardly from the nozzle tube and includes a slot 106 for receiving with lateral clearance a stop pin 108 upstanding from a support ledge 110 on the range tube. The bracket arm extends further through a generally U-shaped contour wrapped over the front of the ledge and captured by a pivot pin 112 for rotation about a vertical axis. The lower end of the bracket arm 104 carries one end of a trip spring 114 having its other end carried by an actuator arm 116.

The actuator arm 116 has a generally U-shaped section 118 at its lower end and extends therefrom over the front of the support ledge 110 generally in overlying relation with the bracket arm 104. The actuator arm 116 is also captured by the pivot pin 112 for rotation about the pin vertical axis and terminates in a rearwardly open, laterally elongated slot 120 receiving the upper end of the stop pin 108.

The stop pin 108 thus functions to limit the degree of rotational movement of both the actuator arm 116 and the bracket arm 104 about the axis of the pivot pin 112, whereas the trip spring 114 functions to rotate the bracket arm 104 in a direction opposite the actuator arm 116 in response to actuator arm rotation. Thus, as the actuator arm 116 is rotated in one direction within the limits of its slot 120, the trip spring 114 forces the bracket arm 104 to rotate in the opposite direction within the limits of its slot 106. This movement is attended by switching of the nozzle tube 76 between positions displaced angularly, by about 10 degrees or so, sufficient to switch the low pressure water stream 30 from alignment with one deflector spoon to alignment with the other deflector spoon, thereby switching the rotational stepping direction of the range tube, as described above. Conveniently, as shown best in FIG. 5, the upper end of the bracket arm 104 can be coated with a layer 105 of soft plastic material or the like to prevent unduly rapid wear of the nozzle tube from the bearing engagement with the bracket arm.

The actuator arm 116 is rotated back and forth in response to movement of the range tube to the end limits of a preselected arcuate path. More specifically, the U-shaped lower end 118 of the actuator supports a downwardly projecting trip pin 122 having its lower end engageable with outwardly projecting tabs 124 and 126 of a pair of clamp springs 128 and 130 wrapped about the bearing assembly 12. These tabs 124 and 126 of the clamp springs may be positioned at selected locations about the circumference of the bearing assembly to define the end limits of the preselected arcuate path through which the range tube is to be rotated. When the trip pin 122 engages the tab 124 of the clamp spring 128, a force is imparted through the trip pin 122 to rotate the actuator arm 116 to its alternative position thereby rotating the bracket arm 104 and thereby further shifting the position of the movable nozzle tube 76 to its alternative position resulting in reversal of the direction of range tube rotation. When the trip pin 122 contacts the other tab 126 at the opposite end limit of the arcuate path, the actuator and bracket arms 116 and 104 are switched back to also return the nozzle tube and again reverse the direction of range tube rotation. Conveniently, however, if full-circle rotation is desired, the trip pin 122 can be lifted to its dotted line position in FIG. 2 and retained thereat by a generally U-shaped clip spring 130 away from engagement with the underlying tabs 124 and 126.

Accordingly, the reaction drive sprinkler of this invention provides a reaction drive arm 24 mounted for simple pivoting motion, yet capable of providing reaction forces for reversibly driving the range tube through a preselected arcuate path. The high energy water stream 18 is not interrupted, thereby permitting projection thereof through an optimum range and permitting controlled and relatively slow stepwise reversals in direction. In addition, all driving forces are derived from the low pressure water stream 30 to substantially alleviate or eliminate abrasion problems of the deflector spoons, particularly since entrained grit and the like tends to remain in the high energy stream 18, and thereby permit the reaction drive arm 24 including the spoons 26 and 28 to have an integral construction formed from a lightweight and inexpensive material, such as cast aluminum or the like.

In accordance with a further aspect of the invention, means are provided for varying the frictional resistance to rotation of the range tube 16 in a manner to maintain the rate of rotation substantially constant throughout a range of water supply pressures. More particularly, the frictional resistance is increased with increasing water pressure to counter increased reaction forces arising from the increased water pressure.

Figure 14:
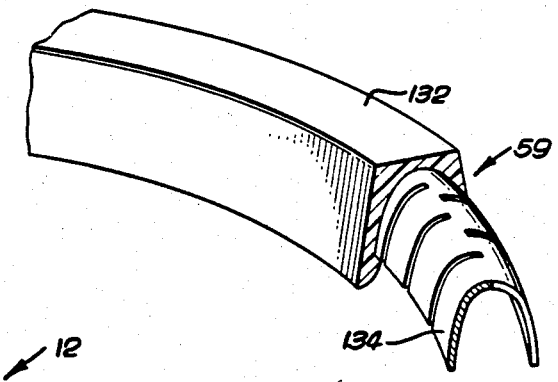
FIG. 14 is an enlarged fragmented perspective view illustrating a preferred pressure-responsive seal member.
Figure 13:
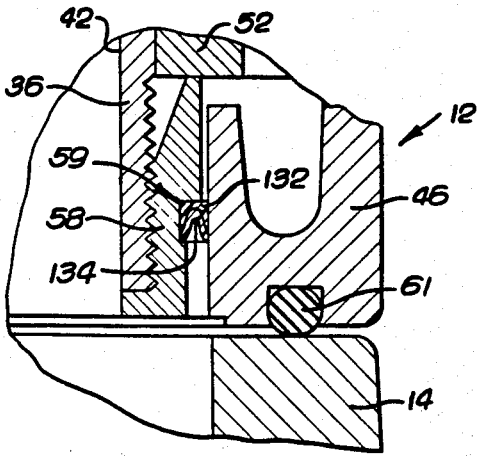
FIG. 13 is a further enlarged fragmented vertical section illustrating a portion of the bearing assembly.

In a preferred form, the annular seal member 59 positioned between the lower half 46 of the bearing case and the friction collar 58 is constructed to provide the desired pressure-responsive variation in frictional resistance to range tube rotation. As shown best in FIGS. 2, 13, and 14, this seal member 59 comprises a force-biased seal member in the form of a downwardly open annular lip seal 132 having a generally U-shaped cross section and formed preferably from a resilient or elastomeric material. A spring 134 of a lightweight metal or the like also has a downwardly open and generally U-shaped cross section and is received into the lip seal 132 to spread the legs of the lip seal respectively into bearing engagement with the case half 46 and the friction collar 58. Accordingly, the composite seal member 59 frictionally engages and seals between the case and the friction collar. However, as water pressure within the standpipe increases, the water pressure is exposed to the open side of the seal member 59 and acts to assist the biasing force of the spring 134 thereby increasing the frictional resistance between the case and the friction collar. This increased frictional resistance serves to maintain the rate of range tube rotation substantially constant throughout a range of water pressures, such as can be encountered when a plurality of reaction drive sprinklers are coupled at different terrain elevations to a common water supply.

According to a further aspect of the reaction drive sprinkler of this invention, the discharge nozzle assembly 22 is provided at the outlet end of the range tube for selectively tailoring the high energy flow stream 18 and for selectively adjusting the angle of inclination thereof. This nozzle assembly 22 comprises, as illustrated in FIGS. 1, 2, and 9–12, a guide tube 136 having internal radially inwardly projecting antiswirl vanes 138 for reducing swirl in the high energy flow stream passing through the range tube, in combination with one of a plurality of interchangeable nozzle inserts having a converging internal flow of desired shape, wherein the nozzle insert is adapted for slight misalignment with respect to a central axis 140 of the discharge barrel 40 to alter the inclination angle of the projected water stream 18.

Figure 9:
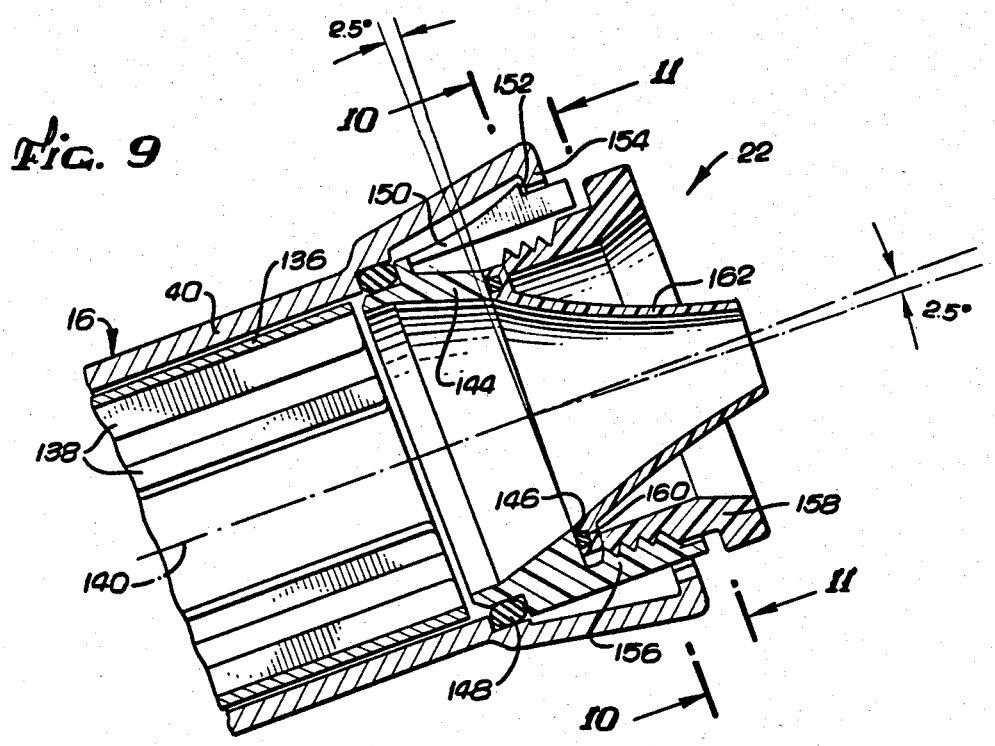
FIG. 9 is an enlarged fragmented vertical section of a portion of the sprinkler to illustrate construction details of a discharge nozzle assembly.
Figure 10:
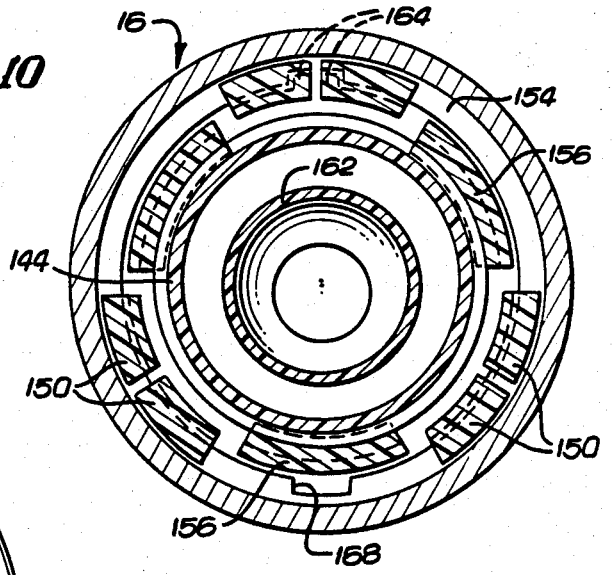
FIG. 10 is a fragmented section taken generally on the line 10—10 of FIG. 9.
Figure 11:
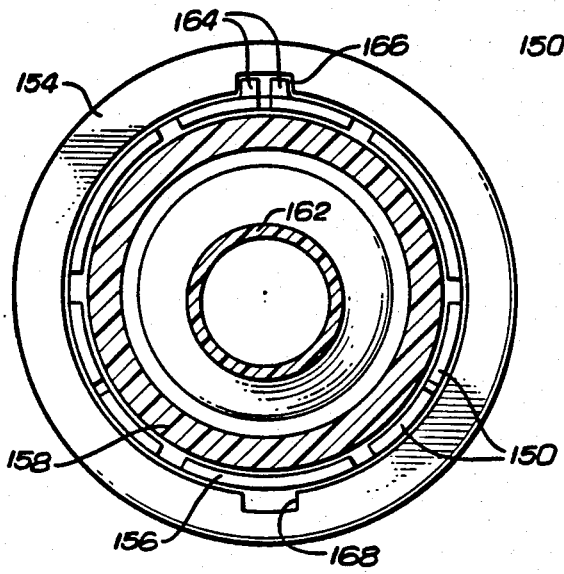
FIG. 11 is a fragmented section taken generally on the line 11—11 of FIG. 9.
Figure 12:
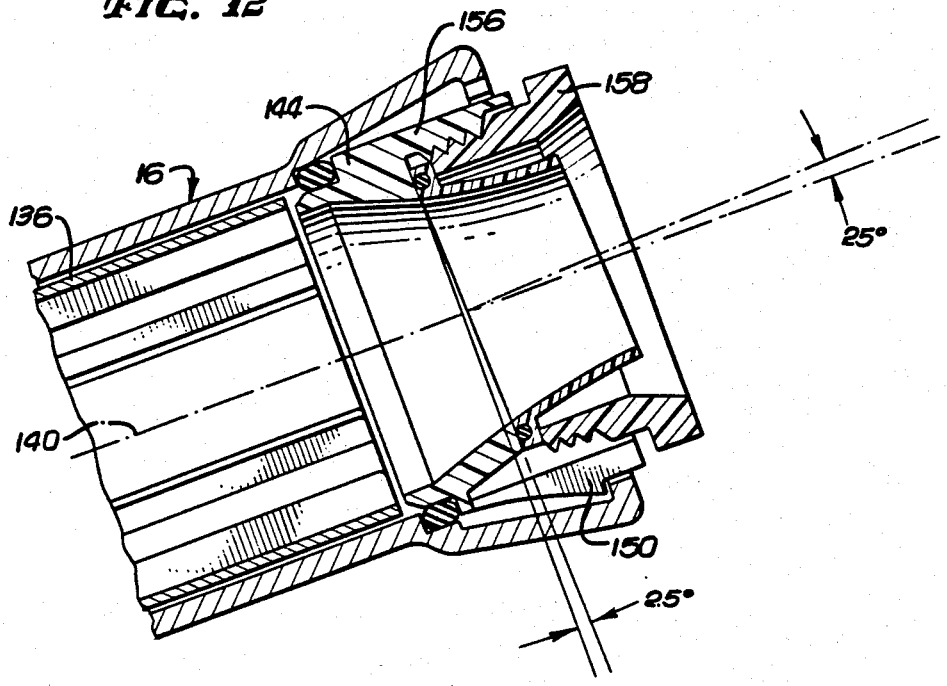
FIG. 12 is a fragmented vertical section similar to FIG. 9 illustrating the discharge nozzle with an alternative nozzle insert for use therewith.

This guide tube 136 is inserted into the open end of the range tube 16 into axial engagement with an annular shoulder 142 therein. A nozzle base ring 144 snap-fits into the open end of the range tube to bear against the downstream end of the guide tube to retain the guide tube in place with a seal ring 148 or the like being trapped therebetween to prevent leakage. The base ring 144 is conveniently formed from a lightweight plastic or the like to have a generally annular configuration including an axially outwardly presented annular seat 146 surrounded by a plurality of spring fingers 150 defining axially presented shoulder stops 152 which are pressed beyond and then spring outwardly for engagement with a radially inwardly projecting rim 154 at the discharge end of the range tube. These spring fingers 150 are formed alternatively about the circumference of the base ring with a plurality of internally threaded support fingers 156 for threadably receiving an annular retainer nut 158 which traps an enlarged flange 160 of a selected nozzle insert 162 against the base ring seat 146. This nozzle 162 can be one of several interchangeable nozzle inserts, as illustrated in FIGS. 9 and 12, to define a smooth converging contour of selected diameter at its discharge end for passage of the high energy water stream 18.

According to one aspect of the invention, the annular seat 146 of the base ring 144 is formed in slight axial misalignment with respect to the adjacent central axis 140 of the range tube 16. Thus, by orienting the base ring 144 to alter the water stream 18 slightly upwardly or slightly downwardly with respect to the range tube axis 140, the angle of inclination of the projected flow stream can be adjusted without requiring any adjustment in the geometry of the range tube. Conveniently, this alternative positioning of the base ring 144 is facilitated by means of an alignment tab 164 on the base ring for fitting into either an upper notch 166, as viewed in FIG. 11, or a lower slot 168, as viewed in FIG. 12, in the discharge end of the range tube.

In one specific operating example of the invention, the discharge barrel 40 of the range tube 16 was oriented at an angle of inclination at about 20.5 degrees to a horizontal plane. The base ring 144 was configured to support a selected nozzle insert in misalignment of about 2.5 degrees with respect to the range tube. Thus, by orienting the nozzle insert to project slightly upwardly with respect to the range tube, the angle of inclination of the projected high energy water stream 18 was chosen to be the sum of 20.5 degrees and 2.5 degrees, or 23.0 degrees. Alternatively, by orienting the nozzle insert to project slightly downwardly with respect to the range tube, the angle of inclination of the projected high energy water stream 18 was 20.5 degrees minus 2.5 degrees, or 18.0 degrees. Thus, the discharge nozzle assembly 22 permits the reaction drive sprinkler 10 of this invention to project a high energy water stream at more than one angle of inclination without requiring any alteration to the geometry of the range tube.

The reaction drive sprinkler of this invention thus provides a sustantially improved and simplified construction for reversibly driving the sprinkler through a preselected arcuate path at a constant rate throughout a range of water pressures and without interrupting the high energy water stream. Moreover, the invention provides such rotational motion without rapid reversals in rotation and without excessive abrasion wear of water deflecting components. The invention further permits adjustment in the angle of inclination of the projected high energy water stream without requiring any changes to the sprinkler range tube.

A variety of modifications and improvements to the invention described herein are believed to be apparent to one skilled in the art. Accordingly, no limitation on the invention is intended, except by way of the appended claims.

What is claimed is:

1. In a rotatable water sprinkler having a range tube for rotatable connection with respect to a water supply pipe to receive water from the supply pipe and to project the water in the form of at least one water stream in a generally lateral direction with a selected angle of inclination with respect to the supply pipe, the improvement comprising:

reaction drive means including a drive arm pivoted with respect to the range tube and supporting at least one deflector spoon oriented for selectively interrupting the projected water stream resulting in reaction forces to rotate the range tube with respect to the supply pipe;

means for mounting said range tube at the end of the water supply pipe for rotation with respect thereto; and means responsive to increases in the pressure of water in the supply pipe for increasing frictional resistance to rotation of said range tube with respect to the water supply pipe, said pressure responsive means comprising an annular lip seal interposed between said mounting means and said range tube and having a generally U-shaped cross section opening toward the water supply pipe, and an annular spring received into said lip seal for biasing the opposite leg of said lip seal into normal frictional sealing engagement respectively with said mounting means and said range tube, said spring having a generally U-shaped cross section opening toward the water supply pipe such that increases in water pressure supplement the spring force to increase frictional resistance to rotation of said range tube.

2. A rotatable water sprinkler for connection to a water supple pipe, comprising:

a range tube having a flow path therethrough for receiving water from the water supply pipe and for discharge projection of the water generally in a lateral direction with respect to the water supply pipe; and means for mounting said range tube onto the water supply pipe for rotation with respect to the water supply pipe, said mounting means including seal means responsive to the pressure of water in the supply pipe including a pair of seal legs and retainer means for respectively retaining said seal legs in normal sealing and frictional engagement with said mounting means and said range tube and for increasing frictional resistance to rotation of said range tube with respect to the supply pipe in response to increases in the water pressure and for decreasing frictional resistance to range tube rotation in response to decreases in the water pressure.

3. The rotatable water sprinkler of claim 2 including means driven by water discharged from said range tube for drivingly rotating said range tube with respect to the water supply pipe.

4. The rotatable water sprinkler of claim 2 wherein said mounting means comprises a bearing case for connection to the end of the water supply pipe and a bearing rotationally supporting said range tube with respect to said bearing case.

5. The rotatable water sprinkler of claim 4 wherein said pressure responsive seal means comprises an annular lip seal interposed between said bearing case and said range tube and having a generally U-shaped cross section defining said seal legs opening toward the water supply pipe, and wherein said retainer means comprises an annular spring received into said lip seal for biasing the opposite seal legs of said lip seal into normal frictional sealing engagement respectively with said bearing case and said range tube, said spring having a generally u-shaped cross section opening toward the water supply pipe such that increases in water pressure supplement the spring force to increase frictional resistance to rotation of said range tube.

6. A rotatable water sprinkler for connection to a water supply pipe, comprising:

a range tube having a flow path therethrough for receiving water from the water supply pipe and for discharge projection of the water generally in a lateral direction with respect to the water supply pipe;

bearing means for mounting said range tube for rotation with respect to the water supply pipe;

means driven by water discharged from said range tube for drivingly rotating said range tube with respect to the water supply pipe; and pressure responsive means frictionally engaging said range tube and said bearing means for increasing and decreasing the frictional resistance to range tube rotation respectively in response to increases and decreases in the pressure of water in the supply pipe;

said pressure responsive means including an annular lip seal interposed between said bearing means and said range tube and having a generally U-shaped cross section opening toward the water supply pipe, and an annular spring received into said lip seal for biasing the opposite legs of said lip seal into normal frictional sealing engagement respectively with said bearing means and said range tube, said spring having a generally U-shaped cross section opening toward the water supply pipe such that increases in water pressure supplement the spring force to increase frictional resistance to rotation of said range tube.

7. A water sprinkler, comprising:

a sprinkler body having a flow path therethrough for receiving water from a water supply pipe and for discharge projection of the water generally outwardly therefrom;

means for mounting said sprinkler body at the end of the water supply pipe for rotation with respect thereto and for reception of water from the supply pipe into the sprinkler body flow path;

means for rotatably driving said sprinkler body with respect to the water supply pipe; and seal means responsive to the pressure of water in the supply pipe and including a pair of seal legs and retainer means for respectively retaining said seal legs in normal sealing frictional engagement with said mounting means and said sprinkler body and for increasing frictional resistance to rotation of said sprinkler body with respect to the supply pipe in response to increases in the water pressure and for decreasing frictional resistance to sprinkler body rotation in response to decreases in the water pressure.

8. The water sprinkler of claim 7 wherein said pressure responsive seal means comprises an annular lip seal interposed between the water supply pipe and said sprinkler body and having a generally U-shaped cross section defining said seal legs opening toward the water supply pipe, and wherein said retainer means comprises an annular spring received into said lip seal for biasing the opposite seal legs of said lip seal into normal frictional sealing engagement respectively with the water supply pipe and said sprinkler body, said spring having a generally U-shaped cross section opening toward the water supply pipe such that increases in water pressure supplement the spring force to increase frictional resistance to rotation of said sprinkler body.

9. In a rotatable water sprinkler having a range tube for rotatable connection with respect to a water supply pipe to receive water from the supply pipe and to project the water in the form of at least one water stream in a generally lateral direction with a selected angle of inclination with respect to the supply pipe, the improvement comprising:

reaction drive means including a drive arm pivoted with respect to the range tube and supporting a pair of generally oppositely oriented deflector spoons for selectively interrupting the projected water stream respectively resulting in reaction forces to rotate the range tube in opposite rotational directions wiht respect to the supply pipe, and further including nozzle means mounted on the range tube for discharge passage of the water stream and for movement between a first position aligning the water stream for interruption by one of the deflector spoons and a second position aligning the water stream for interruption by the other deflector spoon, and reversing means for moving said nozzle means between said first and second positions; and means responsive to increases in the pressure of water in the supply pipe for increasing frictional resistance to rotation of said range tube with respect to the water supply pipe.

* * * * *